US005623732A

United States Patent [19]

Olajide, Jr.

[11] Patent Number: 5,623,732

[45] Date of Patent: Apr. 29, 1997

[54] HAT IN COMBINATION WITH A HOOD

[76] Inventor: Michael A. Olajide, Jr., 64 E. 34th St., Suite 5A, New York, N.Y. 10016

[21] Appl. No.: 268,164

[22] Filed: Jun. 28, 1994

Related U.S. Application Data

[63] Continuation-in-part of Ser. No. 832,757, Feb. 6, 1992, abandoned.

[51] Int. Cl.[6] ..... A42B 1/18

[52] U.S. Cl. ..... 2/195.1; 2/172; 2/202; 2/209.13

[58] Field of Search ..... 2/4, 172, 195.1, 2/202, 209.13, 195.5, 10; D2/884

[56] References Cited

U.S. PATENT DOCUMENTS

| | | | |
|---|---|---|---|
| D. 31,107 | 6/1899 | Davis . | |
| 32,849 | 7/1861 | Whipple . | |
| D. 136,334 | 9/1943 | Witz . | |
| D. 155,443 | 10/1949 | Noped . | |
| D. 168,920 | 2/1953 | Wittcoff . | |
| D. 309,523 | 7/1990 | Martin . | |
| D. 315,439 | 3/1991 | Lorentzen, Jr. . | |
| D. 337,645 | 7/1993 | Guziejka | D2/884 |
| 345,807 | 7/1886 | Schlesinger . | |
| 394,469 | 12/1888 | Dormer et al. . | |
| 419,765 | 1/1890 | Frank . | |
| 674,392 | 5/1901 | Bortfeldt . | |
| 946,770 | 1/1910 | Sands . | |
| 1,677,187 | 7/1928 | Leibson . | |
| 2,648,847 | 8/1953 | Crowder | 2/195.5 |
| 2,897,510 | 8/1959 | Forbes-Robinson | 2/172 |
| 4,980,928 | 1/1991 | Ellis . | |
| 5,046,195 | 9/1991 | Koritan . | |
| 5,153,943 | 10/1992 | Clement . | |
| 5,161,259 | 11/1992 | Shorts . | |
| 5,282,278 | 2/1994 | Miner . | |
| 5,410,761 | 5/1995 | Connelly et al. | 2/195.1 |

*Primary Examiner*—Diana Biefeld
*Attorney, Agent, or Firm*—Ostrolenk, Faber, Gerb & Soffen, LLP

[57] ABSTRACT

A hat in combination with a hood includes a hat having a cap portion for fitting on the head of a hat wearer, a front visor and a rear visor. The front visor and the rear visor are attached to opposite ends of the cap portion. A hood is adapted to cover the backside of the wearer and is releasably attached to the hat body. A pocket stores the hood to retain it off of the backside of the wearer.

18 Claims, 3 Drawing Sheets

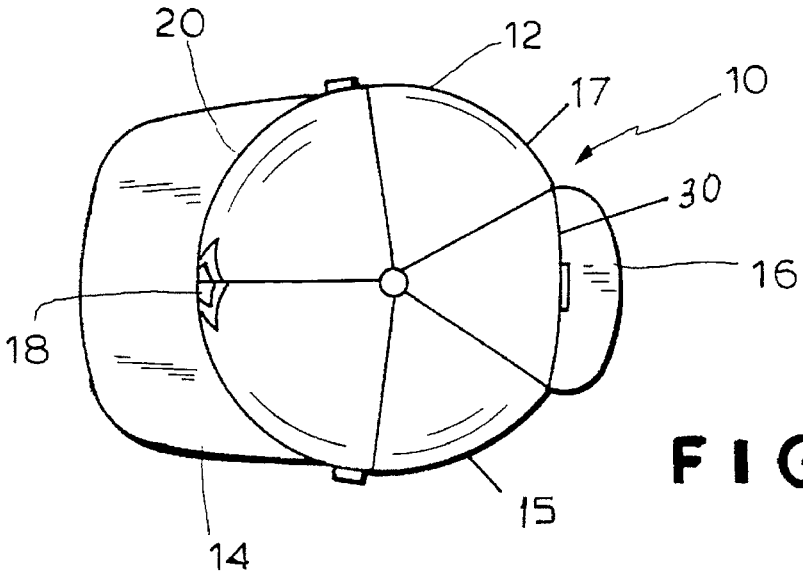
FIG. 1
FIG. 2
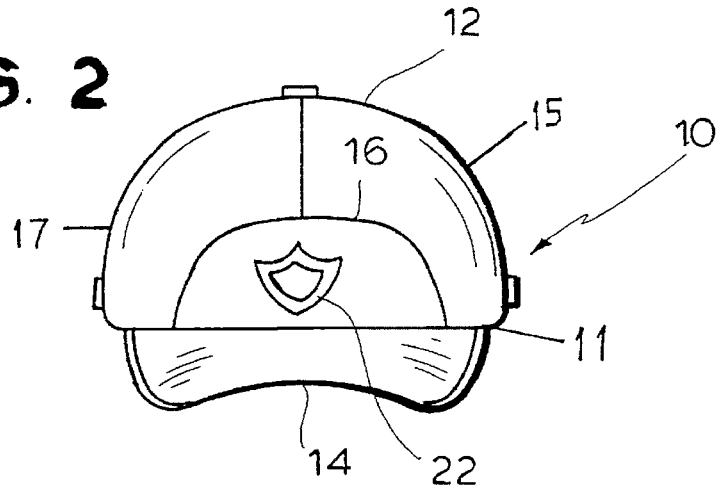
FIG. 3
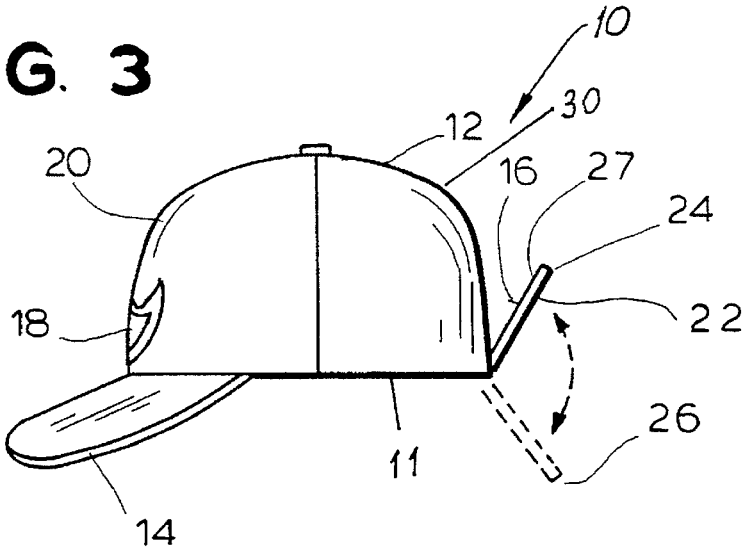

FIG. 6
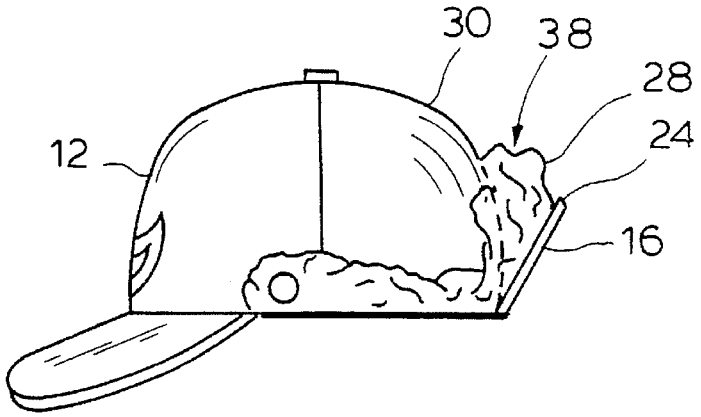
FIG. 7
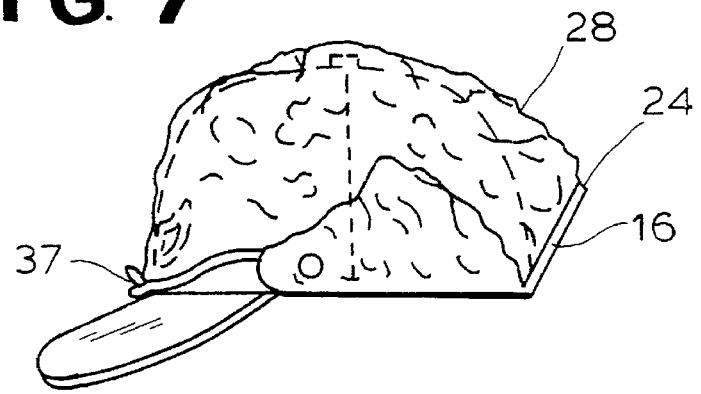
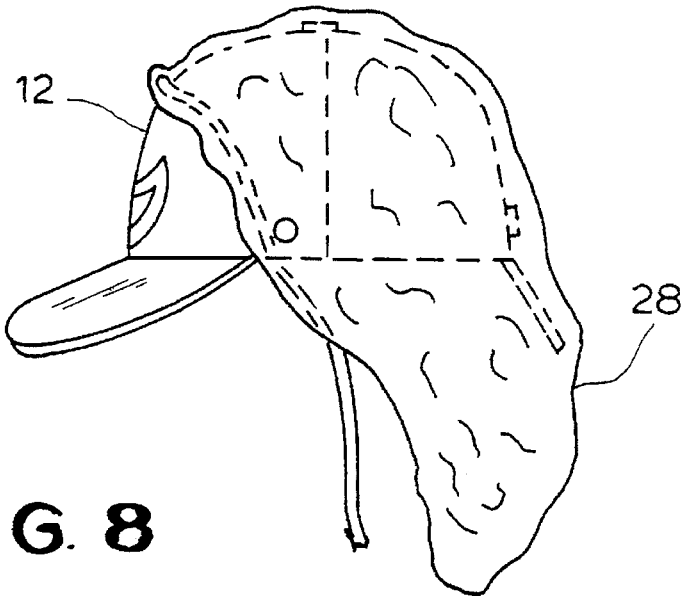
FIG. 8

HAT IN COMBINATION WITH A HOOD

RELATED APPLICATION

This is a continuation-in-part of application Ser. No. 07/832,757 filed Feb. 6, 1992, now abandoned.

BACKGROUND OF THE INVENTION

1. Field of the Invention

The present invention relates to a hat and more particularly to a hat in combination with a hood.

2. Description of the Prior Art

For as long as there has been baseball, there have been baseball style hats or caps. People wear their caps for all occasions. They are generally made of a fabric or woven material having a hemispherical crown. The crown may also be cylindrical with a flat top. Inside the crown at the lower periphery is located a rim or band of reinforced material for securing the cap to the head. At the forward lower periphery portion of the crown is located a stiff visor or bill to assist in keeping the sun out of the eyes of the wearer, or to shield the face of the hat wearer when engaged in activities such as jump roping and the like. Also on the outside of the forward crown portion, indicia or advertising is most common. This construction is universal with respect to all known baseball style caps.

At the rearward portion of the crown, baseball caps begin to somewhat deviate. There are customized caps which have a continuous rim or band around the lower periphery of the crown for exact size fitting for a specific head size. Baseball caps are also made which are adjustable. At the rearward portion of the crown, these caps have a semicircular opening including a band sizing adjustment. Both these styles are typically bare of indicia or the like at the rearward crown portion.

Recently it has become fashionable for kids and young adults to wear their baseball caps with the visor directed rearward. Wearing the cap in this orientation de-emphasizes the advertising or indicia on the crown forward portion which is undesirable by merchants, and leaves the wearer's face exposed to the elements such as sunlight, rain, etc., and to the impact of a jump rope when engaged in that activity.

Furthermore, in many fields of endeavor and activities, persons are exposed to adverse climatic conditions for extended periods of time. For example, a tennis player or jogger may be continuously exposed to strong sunlight for many hours. That same person may also be exposed to winds or rain for similar extended periods of time.

This prolonged exposure can lead to a number of physical problems. The sun exposure can at a minimum cause a sunburn of the skin. Over a long period of time, repeated over-exposure to the sun can result in skin cancer. Exposure to winds can result in windburn, drying of the skin and abrasion of the skin.

Hats, and most commonly, baseball style hats, are not only used as a fashion accessory, but to protect the wearer from the sun and the other elements. A problem with these hats is that when the sun is not directly overhead, the rays of the sunlight are able to impinge on the wearer's neck, face and ears. A similar problem is that the hat will not protect the backside of the wearer, i.e., the neck, shoulder and/or back areas, from the elements, e.g. the sun, the rain or the like.

A scarf or bandanna may be used by the wearer as a shield to protect him or her from the elements. A problem with a scarf is that when it is used in combination with a hat, the scarf is not easily stowed when use of the scarf is not desired. Another problem is that it is difficult to use the hat and scarf to effectively and conveniently protect both the head and backside of the hat and scarf wearer from the elements.

SUMMARY OF THE INVENTION

The present invention is directed towards a hat including a cap portion for fitting on the head of a hat wearer, a front visor and a rear visor, the front visor and the rear visor being attached to opposite ends of the cap portion. A hood is adapted to cover the backside of the wearer and includes means for releasably attaching the hood to the hat body. A pocket stores the hood on the hat body to retain the hood off of the backside of the hat wearer.

Preferably, the rear visor is capable of moving between an upper position and a lower position.

In a preferred embodiment, the pocket for storing the hood is defined by the cap portion and the rear visor when the rear visor is engaged in the upper position. The pocket is of a sufficient size to stow at least part of the hood to retain the hood off of the backside of the hat wearer.

Preferably, the hood is deployed to cover the backside of the hat wearer when the rear visor is in the lower position. The rear visor is engaged in the upper position when the hat is worn by the hat wearer or when not worn by the hat wearer.

In a preferred embodiment, the hood is deployed to cover both the backside of the hat wearer and the cap portion when the rear visor is in the lower position.

Preferably the hat and hood include means for securing the hood around the cap portion. In a preferred embodiment, the means for securing the hood is a draw string.

In a preferred embodiment, the rear visor includes a first side and a second side, and an emblem is visibly attached to the first side. The emblem can be visibly attached to the second side.

In a preferred embodiment, the hat is a baseball style hat. Preferably, the means for releasably attaching the hood to the hat body includes snap fasteners or hook and loop fasteners. The hood can include an emblem visibly attached thereto.

Other features and advantages of the present invention will become apparent from the following description of the invention which refers to the accompanying drawings.

BRIEF DESCRIPTION OF THE DRAWINGS

For the purpose of illustrating the invention, there is shown in the drawings an embodiment which is presently preferred; it being understood, however, that the invention is not limited to the precise arrangements and instrumentalities shown.

FIG. 1 is a top plan view of the hat of the present invention.

FIG. 2 is a rear elevation view of the hat of FIG. 1 showing a rear visor in the up position.

FIG. 3 is a side elevation view of the hat of FIG. 1 showing the rear visor moving between a first up position and a second down position.

FIG. 6 is a side elevation view of the hat and hood combination of FIG. 5, with the hood in a stowed position.

FIG. 7 is a side elevation view of the hat and hood combination of FIG. 5, with the hood in a partially stowed position to cover the top of the cap.

FIG. 8 is a side elevation view of the hat and hood combination of FIG. 5 in a partially deployed position to cover the top of the hat.

DETAILED DESCRIPTION OF THE INVENTION

Figure 5:
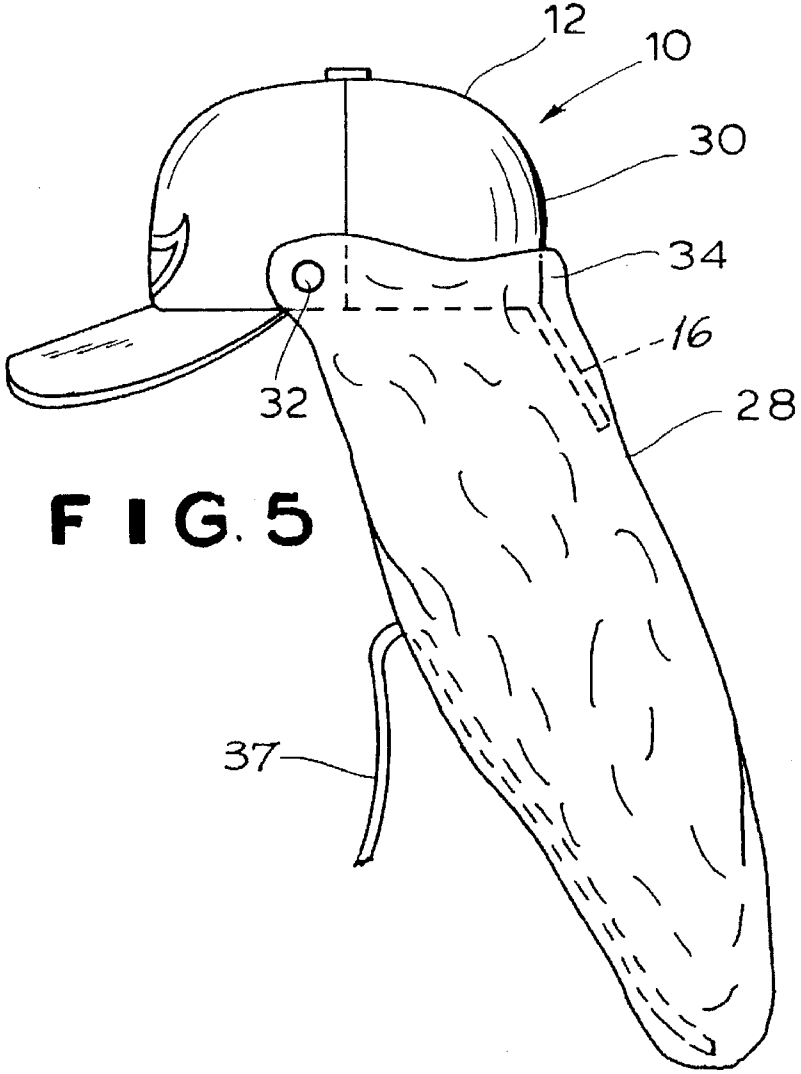
FIG. 5 is a side elevation view of the hat and hood combination of FIG. 4.

Referring now to the drawings wherein like numerals indicate like elements, there is shown in FIGS. 1–3 a hat generally designated by the numeral 10. The hat includes a cap portion or crown 12 designed to fit over the head of a hat wearer, the crown including a peripheral edge 11, a front portion 20 and a rear portion 30, the front and the rear portions being significantly spaced from each other by two sides, 15 and 17. The hat also including; a front visor 14 and a rear visor 16 attached to opposite ends of the cap portion 12 on the peripheral edge 11 of the crown 12. The hat 10 is preferably, but need not be limited to, a baseball style cap and can be constructed in accordance with any known method and of any desirable material.

The hat 10 can be made in different sizes to fit different sized heads. The hat 10 can also be made adjustable so that it will fit the head of most any hat wearer, by utilizing any of the known adjustment means including elastic bands, band sizing adjustment straps, or the like.

It is fashionable for children and young adults to wear hats, particularly baseball caps, with the visor directed rearward. This, however, de-emphasizes the advertising or indicia 18 commonly worn on the forward portion 20 of the hat which is not desired by merchants. The advertising or indicia 18 may be a name, emblem, crest, advertisement, trademark, team name, number or other matter whether printed or embroidered. To solve this problem, Applicant's hat 10 of the present invention, when worn rearward, results in the rear visor 16 facing forward. The rear visor 16 can then include advertising or indicia 22.

Referring now to FIG. 3, the rear visor 16 is pivotally connected to the cap portion 12 and is capable of moving between a first upward position 24 and a second downward position 26 when the hat 10 is worn by the hat wearer. When the hat 10 is worn, this causes the rear visor 16 to stiffen up and, therefore, remain in the first upward position 24, or the second downward position 26, whichever is desired. It is also within the scope of the present invention to move the rear visor 16 between a first upward position 24 and a second downward position 26 when the hat 10 is not worn by the hat wearer. In this embodiment, the rear visor 16 can be constructed and arranged to remain in the first upward position 24 or the second downward position 26, whichever is desired, by any of the known methods.

When the cap 10 is worn such that the rear visor 16 faces forward, and is in the upward position 24, the advertising or indicia 22 (in the illustrated embodiment) is now emphasized from the forward point of view. The advertising or indicia 18 is still visible, but from a rearward point of view. The hat 10 can, of course, be worn in the opposite way such that the front visor 14 and advertising or indicia 18 faces forward and the rear visor and advertising or indicia 22 faces rearward. Advertising or indicia 22 can also be placed on the opposite side 27 (or on both sides) of the rear visor 16 so that it will be visible when the rear visor 16 is in the downward position 26.

When the cap 10 is worn in a position such that the rear visor 16 faces forward, Applicant has also found that it achieves the advantage of acting as a shield during physical activities, e.g. jump roping. When the rear visor 16 is in the downward position, Applicant has found that it shields the wearer's face, particularly the eyes, from contact with the jump rope which can lead to serious injury.

Figure 4:
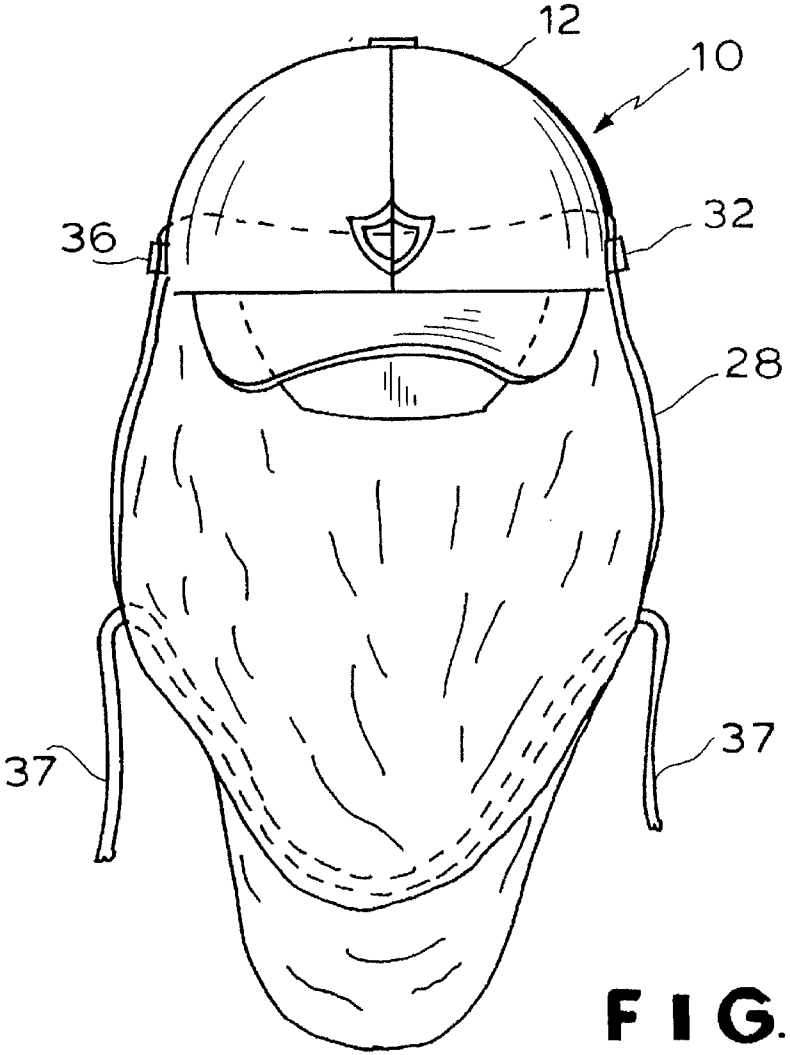
FIG. 4 is a front elevation view of the hat of FIG. 1 in combination with a hood in the fully deployed position.

Referring now to FIGS. 4 and 5, the hat 10 of the present invention is shown in combination with a hood 28. Preferably, the hood 28 is attached to the back portion 30 of the hat 10 so that in its fully deployed position, it shields the backside of the hat wearer, i.e., the neck, shoulder and/or back areas, from the elements, e.g. the sun, the rain or the like. The hat and hood combination can be worn by the wearer on the golf course, jogging course, the beach, leisure area, etc. The hood 28 can be made in accordance with any of the known materials suitable to the particular element(s) from which the wearer seeks protection. For example, the hood 28 can be made of any material that is resistant to the effects of the sun, including cotton, nylon or rayon.

The hood 28 is preferably secured to the rear portion 30 of the hat 10 by snap fasteners 32, 34, and 36. The male portion of the snap fasteners are attached to the cap portion 12 of the hat 10 on opposite sides of the hat 10 and at the rear portion 30 of the hat 10. The corresponding female portion of the snap fasteners are secured to the hood 28 to engage the male portion of the fasteners to secure the hood 28 to the hat 10. It should be realized by those skilled in the art that while snap fasteners are shown and described herein, any type of fastener is within the scope of the present invention just so long that it functions to secure the hood 28 to the hat 10. Examples of other types of fasteners include buttons, hook and loop fasteners sold under the trademark VELCRO, double-sided adhesive tape or the like.

When the hat 10 and hood 28 combination of FIGS. 4 and 5 is worn by the hat wearer, it can be used as a bonnet. This can be accomplished by tieing the draw string 37 around the neck of the hat wearer and partially draping the hood 28 on the hat wearer's shoulders. The hat and hood combination of FIGS. 4 and 5 can also be worn by the hat wearer with the rear visor 16 facing forward. In this configuration, the hood 28 drapes over the face of the hat wearer and can serve as a veil, or as netting to protect the face of the hat wearer from the elements, or from insects if the hood 28 is constructed of a material to repel insects.

Referring now to FIG. 6, the hood 28 is shown in the stowed position. In order to place the hood 28 in this position, the rear visor 16 is first placed in the upward position 24 when the hat 10 is worn by the hat wearer, although it should be realized by those skilled in the art that the hat 10 can be constructed and arranged so that the rear visor 16 can be moved into, and remain in, the upward position 24 when the hat 10 is not worn by the hat wearer. In either embodiment, once the rear visor 16 is in the upward position, a pocket 38 is formed between the rear portion 30 of the hat 10 and the rear visor 16 sufficient in size to stow the hood 28. This keeps the hood 28 off of the backside of the wearer when use of the hood 28 is not desired.

Preferably, the hood 28 is stowed by neatly rolling it up and then placing it in the pocket 38. The draw string 37 can either be neatly stored in the pocket 38 along with the hood 28, or it can be tied around the forward portion 20 of the cap portion 12, as shown in FIG. 7, to keep the sides of the hood in place.

The hood 28 can also be partially stowed in the pocket 38 with the remainder of the hood 28 covering the cap portion 12 of the hat 10, FIG. 7. In this configuration, the draw string 37 is tied around the forward portion 20 of the cap portion 12 to secure the hood 28 around the cap portion 12, although it should be realized by those skilled in the art that any of the known methods can be used to secure the hood 28 around the cap portion 12. When the hood 28 covers the cap portion 12, the hood 28 protects the cap portion 12 and provides the hat wearer with a second layer of protection against the elements.

Referring now to FIG. 8, the hood 28 can be worn in a partially deployed position. In this position, the bottom part of the hood 28, while in the fully deployed position of FIG. 5, is brought over the cap portion 12. The hood 28 now shields both the backside of the hat wearer, and the cap portion 12. In this partially deployed position, the hat 10 and hood 28 can also be used as a bonnet, veil or netting as described above.

The hood 28 can include advertising or indicia, not shown, in addition to, or in place of, the advertising or indicia 18, 22 that appears on the hat 10. The advertising or indicia should be placed on the hood 28 so that it is visible when used in at least one of the ways shown in FIGS. 4–8. The advertising or indicia can be applied to the hood 28 by silk screening or by any of the known methods.

The present invention provides a hat and hood combination that emphasizes advertising indicia. The hood shields the cap and the backside of the wearer from the elements. The hood is easily stowed and deployed. The hat and hood combination is easy to use and manufacture.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A hat in combination with a hood comprising:

a hat including a crown for fitting on the head of a hat wearer, the crown including a lower peripheral edge, a front and a rear, the front and the rear being significantly spaced from each other by two sides, a front visor and a rear visor, the front visor being attached to the lower peripheral edge at the front of the crown and the rear visor being attached to the lower peripheral edge at the rear of the crown, neither the front visor nor the rear visor being attached to any portion of the Peripheral edge on either of the sides of the crown, the rear visor being capable of moving between an upper position and a lower position;

a hood adapted to cover at least part of the backside of a hat wearer;

means for releasably attaching the hood to the hat; and a pocket for storing the hood on the hat to retain at least part of the hood off of the backside of a hat wearer, the pocket being defined by the crown and the rear visor when the rear visor is engaged in the upper position.

2. The hat in combination with a hood of claim 1, wherein the pocket is of a sufficient size to stow at least part of the hood to retain at least part of the hood off of the backside of a hat wearer.

3. The hat in combination with a hood of claim 1, wherein when deployed the hood is adapted to cover at least part of the backside of a hat wearer when the rear visor is in the lower position.

4. The hat in combination with a hood of claim 1, wherein the rear visor is adapted to be engaged in the upper position when the hat is worn by a hat wearer.

5. The hat in combination with a hood of claim 4, including an attacher to secure the hood around the crown.

6. The hat in combination with a hood of claim 5, wherein the attacher is a draw string.

7. The hat in combination with a hood of claim 1, wherein the rear visor is adapted to be engaged in the upper position when the hat is not worn by a hat wearer.

8. The hat in combination with a hood of claim 1, wherein the rear visor includes a first side and a second side, and an emblem is visibly attached to the first side.

9. The hat in combination with a hood of claim 1, wherein the rear visor includes a first side and a second side, and an emblem is visibly attached to the second side.

10. The hat in combination with a hood of claim 1, wherein the hat is a baseball style hat.

11. The hat in combination with a hood of claim 1, wherein the means for releasably attaching the hood to the hat includes a snap fastener.

12. The hat in combination with a hood of claim 1, wherein the means for releasably attaching the hood to the hat includes a hook and loop fastener.

13. The hat in combination with a hood of claim 1, wherein the hood includes an emblem visibly attached thereto.

14. A hat in combination with a hood comprising:

a hat including a crown for fitting on the head of a hat wearer, the crown including a lower peripheral edge, a front and a rear, the front and the rear being significantly spaced from each other by two sides, a front visor and a rear visor, the front visor being attached to the lower peripheral edge at the front of the crown and the rear visor being attached to the lower peripheral edge at the rear of the crown, neither the front visor nor the rear visor being attached to any portion of the peripheral edge on either of the sides of the crown, the rear visor being capable of moving between an upper position and a lower position;

a hood attached to the hat and adapted to cover at least part of the backside of a hat wearer; and a pocket for storing the hood on the hat to retain the hood off of the backside of a hat wearer, the pocket being defined by the crown and the rear visor when the rear visor is engaged in the upper position.

15. The hat in combination with a hood of claim 14, wherein the pocket is of a sufficient size to stow at least part of the hood to retain at least part of the hood off of the backside of a hat wearer.

16. The hat in combination with a hood of claim 14, wherein when deployed the hood is adapted to cover at least part of the backside of a hat wearer when the rear visor is in the lower position.

17. The hat in combination with a hood of claim 14, wherein the rear visor includes a first side and a second side, and an emblem is visibly attached to one of the sides.

18. A hat in combination with a hood comprising:

a hat including a crown having a lower peripheral edge, a front and a rear, the front and the rear being significantly spaced from each other by two sides;

a first visor attached to the front of the crown;

a second visor attached to the rear of the crown, the rear visor being capable of moving between an upper position and a lower position, in which in the upper position an approximate V-shaped pocket is formed between the rear visor and the crown, wherein neither the front visor nor the rear visor is attached to any portion of the peripheral edge on either of the sides of the crown; and a hood adapted to cover at least part of the backside of a hat wearer.

* * * * *